US006295858B1

(12) United States Patent
Torito

(10) Patent No.: US 6,295,858 B1
(45) Date of Patent: Oct. 2, 2001

(54) HEMMING APPARATUS

(75) Inventor: Mitsuru Torito, Hiroshima (JP)

(73) Assignee: Hirotec Corporation (JP)

( * ) Notice: Subject to any disclaimer, the term of this patent is extended or adjusted under 35 U.S.C. 154(b) by 0 days.

(21) Appl. No.: 09/366,050

(22) Filed: Aug. 2, 1999

(30) Foreign Application Priority Data

Aug. 3, 1998 (JP) ..... 10-218395

(51) Int. Cl.[7] ..... B21D 39/02
(52) U.S. Cl. ..... 72/315; 72/452.9; 29/243.58
(58) Field of Search ..... 72/315, 314, 322, 72/452.9, 452.8; 29/243.58

(56) References Cited

U.S. PATENT DOCUMENTS 5,740,691 * 4/1998 Kovarovic ..... 72/306
6,006,576 * 12/1999 Genseberger ..... 72/315

FOREIGN PATENT DOCUMENTS 62-202910 12/1987 (JP) .
1-202319 * 8/1989 (JP) ..... 72/452.9
3-5018 * 1/1991 (JP) ..... 72/452.9

* cited by examiner

*Primary Examiner*—Daniel C. Crane
(74) *Attorney, Agent, or Firm*—Liniak, Berenato, Longacre & White

(57) ABSTRACT

A hemming apparatus is disclosed including a hemming die for placing and supporting a work, a hemming punch including previous bending portion and bending portion each placed adjacent to said heming die and carrying out bending of said work, a slide cam for fixing and supporting said hemming punch and including a cam follower, a moving mechanism for applying a resilient force to said slide cam in one direction and moving said slide cam to a prescribed distance, a cushion holder for placing and fixing said slide cam and said moving mechanism, and a movable supporting mechanism for supporting said cushion holder which can vertically move to a prescribed distance. The upper mold includes a presser for pressing and fixing the work on said hemming die, driver cam for pushing said cam follower of said slide cam; and a liner for pushing said hemming punch.

7 Claims, 8 Drawing Sheets

HEMMING APPARATUS

BACKGROUND OF THE INVENTION

1. Field of the Invention

The present invention relates to a hemming apparatus and a hemming process for bending a work such as a metal plate.

2. Description of the Related Art

Various hemming apparatuses which bend a work such as a door panel for automobile have been suggested. As shown in FIG. 8 which illustrates the state before bending of a work, a hemming apparatus 80 possesses an upper mold 81 and a lower mold 82 and a work W is placed between these molds. The upper mold 81 possesses a driver cam 84 having a slant face 84 and a liner 83. The lower mold 84 is composed of a hemming die 89 for fixing the work W that has already been subjected to a previous bending at the processing position WA, a hemming punch 88 for bending the processing position WA of the work W by compressing the position WA, a supporting pole for supporting the hemming punch 88 which can moves vertically, and a slide cam 85 possessing a slant face 85*a* which is come into contact with the slant face 84*a* provided via a moving mechanism which holds the supporting pole 87 and which can move horizontally.

Consequently, when the processing position WA of the work W is bent, by descending the upper 81 to bring the slant face 84*a* of the driver cam into contact with the slant face 85*a* of the slide cam 85, the slant face 85*a* is compressed. The slide cam 85 is therefore, pushed toward the work W against the resilient force of the moving mechanism 85 and the hemming punch 88 comes to the processing position WA of the work W. By further descending the upper mold 81, the liner 83 pushes the upper side of the hemming punch 88 to carry out the bending of the processing position WA of the work W.

The apparatus described above is disadvantageous in that the previous bending must be carried out by the use of another apparatus. Consequently, an apparatus as shown in FIG. 7 has been suggested (FIG. 7 illustrates the states after the previous bending and bending). To be specific, a hemming apparatus 90 is comprised of an upper mold 91 and a lower mold 92. The upper mold 91 possesses a driver cam 94 having a slant face 94*a* and a liner 93, whereas the lower mold 94 possesses a hemming die 99 for providing the work W and for supporting the position WA of the work W, a hemming punch for carrying out previous bending and bending of the processing position WA of the work W, a slide cam 96 for supporting and fixing the hemming punch 95, a revolving cam 95 provided on the backside of the slide cam 95, and a spring 97 which always apply the resilient force to the slide cam 96 in the backside direction.

Consequently, descending the upper mold 91 whereby the slant face 94*a* pushes the revolving cam 95, the slide cam 96 goes forward against the spring 97 to previously bend the processing position WA of the work W by means of a previous bending slant face 98*a* of a hemming punch 98. Subsequently, the hemming punch 98 is further pushed to go forward so that the face 98*b* to be bent placed on the lower side of the hemming punch 98 is positioned at the position where the bending of the processing position WA of the work W has been finished. The bending is carried out by pressing the face 98*b* by means of the liner 93 from the upper side of the hemming punch 98.

However, the conventional hemming apparatuses have the following problems:

(1) In the case where there coexist linear portions and curved portions at an internal and external circumference portion of the site to be hemmed like window frame of the automobile, it is difficult for the conventional hemming apparatus to carry out bending of the linear portions and curved portions at the narrow position of the work. For this reason, in the conventional hemming apparatus, the bending of the curved portions at the internal circumference portion and the bending of the linear portions at the internal circumference portion are separately carried out. Because of carrying out two separate steps for bending the curved portions and the linear portions, the apparatus should become large as a whole.

(2) Since the hemming conventional apparatuses are separately composed of mounting portions for mounting slide cam and hemming punch, and since they have a large operation by the link mechanism, the rattled portions might be brought about, leading to compression loss and, thus, making it impossible to transmit push compression in an adequate manner. This also results in reduction in the bending precision.

(3) While the conventional hemming apparatuses are required to carry out bending at a compression timing suitable for the conditions of the work, the adjustment of the compression timing, the adjustment thereof is very serious because of complicated construction of the slide cam and other related parts. Moreover, the conventional hemming apparatuses have a large number of parts to be adjusted and, thus, the maintenance of the apparatus is very terrible.

(4) In the case where there are positions to be bent both at the external and internal circumference portions of the work, it is difficult for the conventional hemming apparatuses to secure the space for bending the internal circumference side of the work, making it difficult to design and manufacture the apparatus.

(5) In the case where there are positions to be bent both at the external and internal circumference portions of the work, the conventional hemming apparatuses cannot carry out the bending of the external circumference portion and that of the internal circumference portion at one step. Consequently, the balance between the compressions applied to the external and internal circumference portions of the work is not good and, thus, the deformation of the work might occur.

SUMMARY OF THE INVENTION

The present invention has been made in light of the above situations, and an object of the present invention is to provide a hemming apparatus and, which excels in workability even at a narrow portions, is capable of carrying out bending of linear and curved portion as well as the work at internal and external circumference sides at one step, has a reduced compression loss, excelling in processing precision, is easy to adjust stroke the hemming punch, to design and manufacture of the apparatus, and has good compression balance to the work, and a hemming process using the me.

The first aspect of the present invention is a hemming apparatus composed of opposing upper mold and lower mold;

said lower mold including a hemming die for placing and supporting a work a hemming punch including previous bending portion and bending portion each placed adjacent to said heming die and carrying out bending of said work, a slide cam for fixing and supporting said hemming punch and including a cam follower, a moving mechanism for applying a resilient force to said slide cam in one direction and moving said slide cam to a prescribed distance, a cushion holder for placing and fixing said slide cam and said moving mechanism, and a movable supporting mechanism for supporting said cushion holder which can vertically move to a prescribed distance; and said upper mold including a presser for pressing and fixing the work on said hemming die, driver cam for pushing said cam follower of said slide cam; and a liner for pushing said hemming punch.

The second aspect of the present invention is a hemming apparatus composed of opposing upper mold and lower mold;

said lower mold including a hemming die for placing and supporting a work a hemming punch including previous bending portion and bending portion each placed adjacent to said heming die and carrying out bending of the internal circumference portions of said work, a slide cam for fixing and supporting said hemming punch and including a cam follower, a moving mechanism for applying a resilient force to said slide cam in one direction and moving said slide cam to a prescribed distance, a cushion holder for placing and fixing said slide cam and said moving mechanism, a movable supporting mechanism for supporting said cushion holder which can vertically move to a prescribed distance; and a previous bending punch for carrying out the bending of the external circumference portions of the work; and said upper mold including a presser for pressing and fixing the work on said hemming die, driver cam for pushing said cam follower of said slide cam; and a liner for downwardly moving said cushion holder, a driver cam for driving said previous bending punch for carrying out the bending of the external circumference portions of the work; and a punch for external circumference portions of the work.

The third aspect of the present invention is a hemming process for carrying out the hemming using the apparatus of the present invention comprising:

a first step for supporting and fixing said work onto said hemming die;

a second step for carrying out previous bending of the portion of the work to be bent at the internal circumference corner sides via the hemming punch by means of the movement of said slide cam and at the same time carrying out previous bending of the portion of the work to be bent at the external circumference corner sides via said hemming punch for previous bending;

a third step for carrying out previous bending of the portion of the work to be bent at the internal circumference linear sides via the hemming punch by means of the movement of said slide cam and at the same time carrying out previous bending of the portion of the work to be bent at the external circumference linear sides via said hemming punch for previous bending; and a fourth step for moving the cushion holder downwardly via the movable supporting mechanism by forwarding the hemming punch residing at the previous bending the internal circumference position of the work by means of the movement of the slide cam and then by pushing the hemming punch by the liner placed on the upper mold to carry out the bending of the internal circumference of the work, and carrying out the bending of the external circumference of the work by the external circumference bending punch.

DESCRIPTION OF THE PREFERRED EMBODIMENTS

Figure 1:
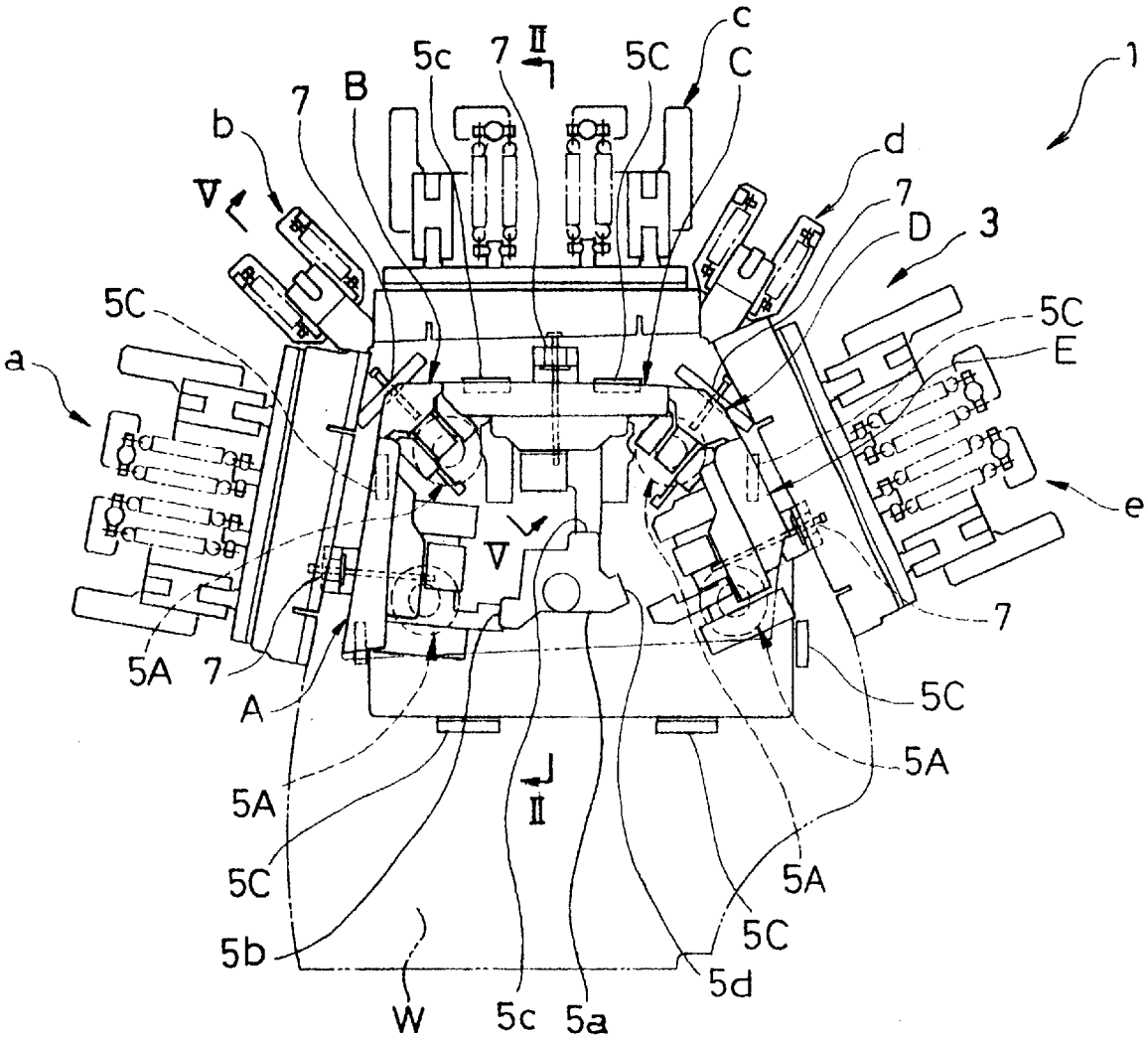
FIG. 1 is a plane view totally showing the lower mold of the hemming apparatus of the present invention.
Figure 2:
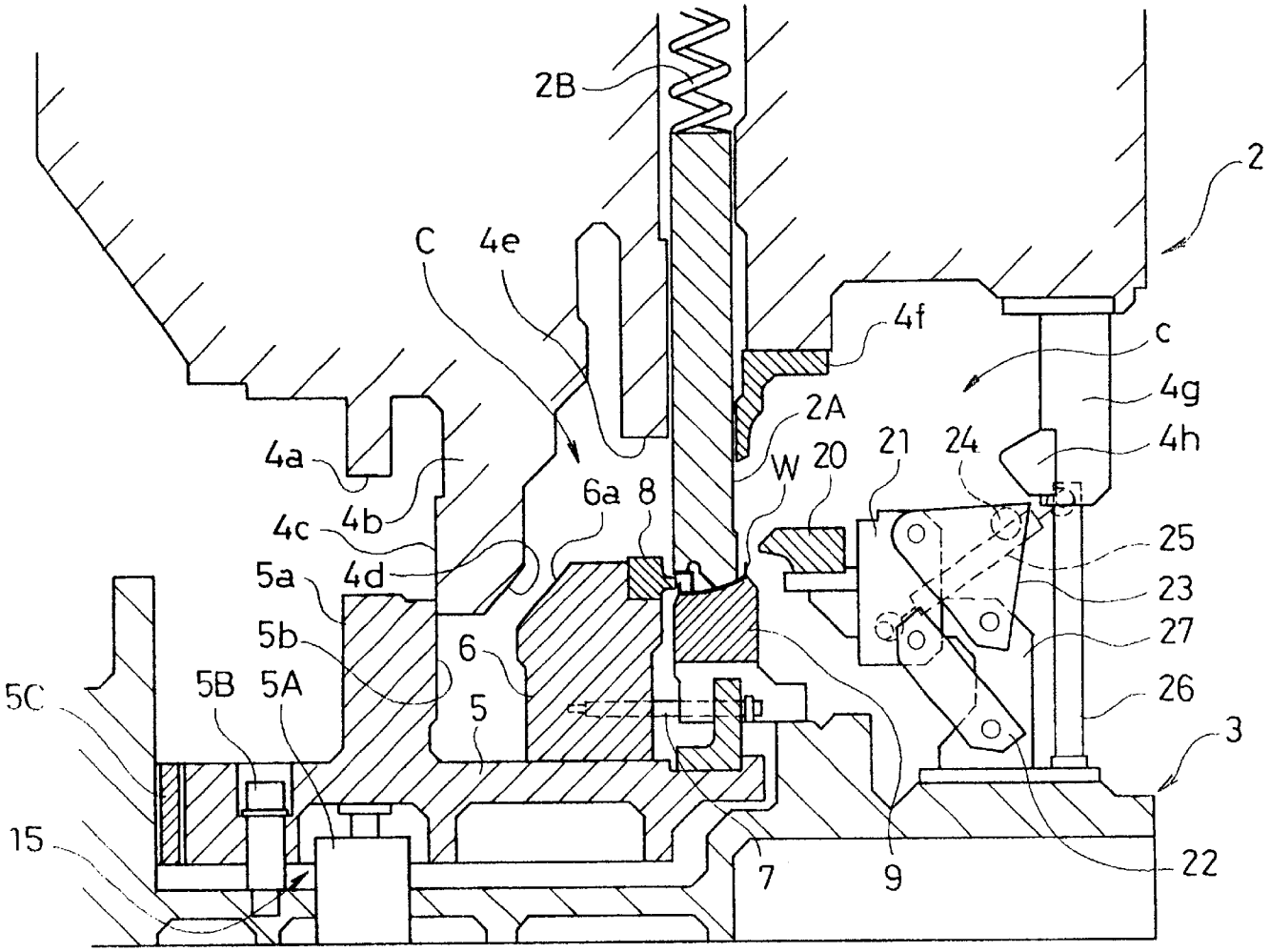
FIG. 2 is a cross-sectional view taken along the line II—II showing the element of the hemming apparatus of the present invention in the state where the upper and lower molds are combined.

As shown in FIG. 1 and FIG. 2, a hemming apparatus 1 (see FIG. 1) is composed of an upper mold 2 placed so that it can move vertically, and a lower mold 3 (see FIG. 2) placed opposite to the upper mold 2. On the lower mold 3, a cushion holder 5 which is vertically movable is placed by a movable supporting mechanism 15, and depending upon the shape of a work W to be hemmed, internal circumference hemming mechanisms A, C, and E, and internal circumference corner hemming mechanisms B, D, and the like are arranged. By referring to these figures, the case where the work W which is a automobile panel composed of a plurality of panels is to be hemmed. In this case, an internal circumference portion Wa and external circumference portion Wb which are the positions to be hemmed of an inner panel W2 and an outer panel W2 (see FIG. 4) will be explained.

As shown in FIG. 1 and FIG. 2, in the hemming apparatus 1, cushion holder 5 which is movable vertically is placed on the lower mold 3. On the upper portions of the cushion holder 5, internal circumference hemming mechanisms A, C, and E for bending curved portion ws (see FIG. 6) to be bent and internal circumference corner hemming mechanisms B and D are placed respectively on the internal circumference Wa and the external circumference Wb of the inter panel w2 and outer panel w1 (see FIG. 4). Also, external circumference previous bending hemming mechanisms a, c, and e and external circumference corner previous bending hemming mechanisms b and e are placed opposite to internal circumference hemming mechanisms A, C, and E and internal circumference corner hemming mechanisms B and D.

As shown in FIG. 1 and FIG. 2, the cushion holder 5 possesses a holder pressing stand 5*a* projecting upwardly at a prescribed position of the cushion holder 5 which is vertically movable, and it is connected via a movable supporting mechanism 15. The movable supporting mechanism 15 is composed of a gas spring 5A which supports the cushion holder 5 in an upper direction by means of a resilient force, a plurality of holder stoppers for regulating the cushion holder 5B so that the cushion holder 5 vertically moves within a prescribed level, and holder guides 5C (8 guides in the figure) placed at prescribed positions around the cushion holder 5.

As shown in FIG. 2 and FIG. 4, the internal circumference hemming mechanism C is composed of a slide cam 6, which is placed on the cushion holder 5 in a vertically movable manner and which has a cam follower 6*a,* a movable mechanism 7 which always applies a resilient force to the slide cam 6 in one direction and, at the same time which guides the slide cam 6 in a movable manner, a hemming punch 8 having a previous bending portion 8*a* and bending portion 8*b* each placed on the upper side of the slide cam 6, and a hemming die 9, which is for placing the work and is fixed onto the lower mold 3. The previous bending portion 8*a* is configured on the lower end face of the hemming punch 8 by placing an R-shape on the lower end face of the hemming punch 8. The bending portion 8*b* forms a surface to be in contact on the lower face side of the hemming punch 8 along the shape of the work W.

As shown in FIG. 1, FIG. 2, and FIG. 4, a hemming mechanism c for previous bending the outer circumference which is placed on and supported by the upper mold 3 is placed opposite to the internal circumference hemming mechanism C at the side of the external circumference Wb of the work W. The hemming mechanism c for previous bending the outer circumference is composed of a previous bending punch 20 for carrying out previous bending of the external circumference Wb, a supporting substrate for supporting the previous bending punch 20 in a detachable manner, movably mounting portions 22 and 23 which mount the supporting substrate 21 to a supporting and fixing portion 27 in a movable manner, a contact interlocking portion 24 which is placed on the movable mounting portion 23, and a spring 25 one end of which is communicated with the supporting substrate 28 and the other end of which is communicated with a fixing pole 26.

Figure 5:
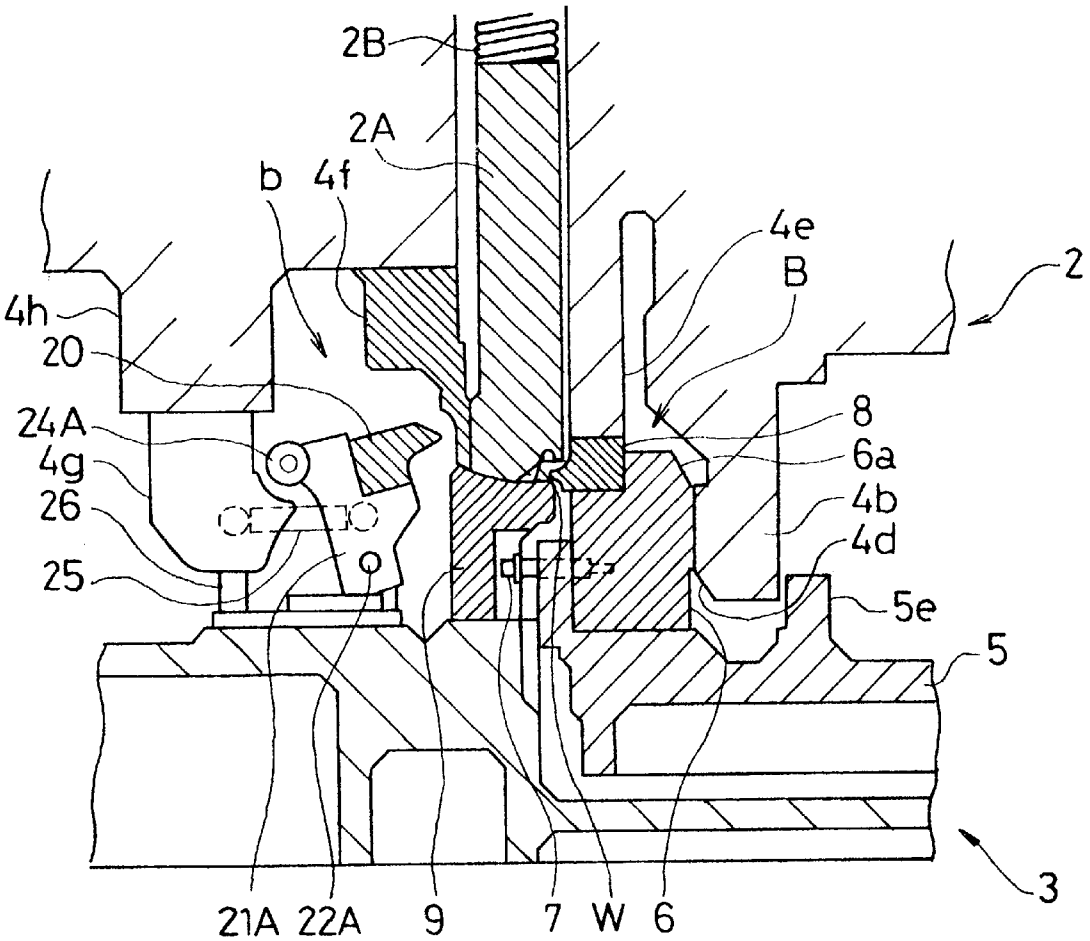
FIG. 5 is a cross-sectional view taken alone the line V—V of FIG. 1 showing an element.

On the other hand, as shown in FIG. 2 and FIG. 5, the upper mold 2 possesses a presser 2A of the work W arranged at the upper portion of the hemming die 9, a plurality of liners 4*e* each of which presses the hemming punch 8 placed at a corresponding portion, another liner 4*a* which presses the holder press stand 5*a,* a plurality of driver cams 4*b,* each of which pushes the slide cam 6 placed at a corresponding portion, a bending punch 4*f* for bending the external circumference of the work W, and driver cams 4*g* for previous bending of the external circumference which push the hemming mechanisms a, c, and e for bending the external circumference (see FIG. 1), and previous bending mechanism b and d for previous bending of the external circumference corners (see FIG. 1).

As shown in FIG. 2, the presser 2A is always applied to a resilient force in a downward direction via a pressing spring 2B. The driver cam 4 has a wear plate 4*b* which is in contact with the cam follower 6*a* of the slide cam 6 at one end thereof, and optionally, possesses another wear plate 4*c* opposite to the wear plate 4*d*.

The configuration of the internal circumference corner hemming mechanism B and the hemming mechanism b for previous bending the external circumference corner will be described by referring to FIG. 5 which shows a cross-section taken along the line V—V of FIG. 1. As for the other hemming mechanisms shown in FIG. 1, i.e., internal circumference hemming mechanisms A and E, the hemming mechanisms a and e for previous bending the external circumference and the hemming e for previous bending the external circumference corner, since their actions are substantially the same as those of the hemming mechanism C for the internal circumference, the hemming mechanism c for previous bending the external circumference, the hemming mechanism B for previous bending the external circumference corner, their descriptions are omitted.

As shown in FIG. 1, FIG. 5, and FIG. 6, the hemming mechanism B for internal circumference corner is placed at the position of the corner portion wc to be bent of the work W, and possesses a slide cam 6 having a cam follower 6*a,* a hemming punch 8 provided at the upper portion of the slide cam 6 in a detachable manner, a moving mechanism 7 which applies a resilient force to the slide cam 6 in one direction so as to freely move the slide cam 6 within a prescribed distance. To be specific, the hemming mechanism B for internal circumference corner has a configuration similar to that of the hemming mechanism C for the internal circumference. In addition, opposite to the hemming mechanism B for internal circumference corner, the hemming mechanism b for previous bending the portion wc to be bent of the external circumference Wb is placed at the side of the external circumference Wb.

Furthermore, the hemming mechanism b for previous bending the external circumference corner has a similar driving mechanism to that of the hemming mechanism c for previous bending the external circumference. Also the hemming mechanism b for previous bending the external circumference corner is formed according to the space of the portion wc to be bent, and is composed of a previous bending punch 20 for the external circumference, a supporting substrate 21 for supporting the previous bending punch 20 for the external circumference, a contact interlocking portion 24A provided on the backside of the upper side of the supporting substrate 21, a movable supporting portion 22A which supports the supporting substrate 21 in a revolving manner, a spring 25 which always applies the supporting substrate 21 to a resilient force in the back side, and a fixing pole 26 which supports the spring 26.

Figure 3A:
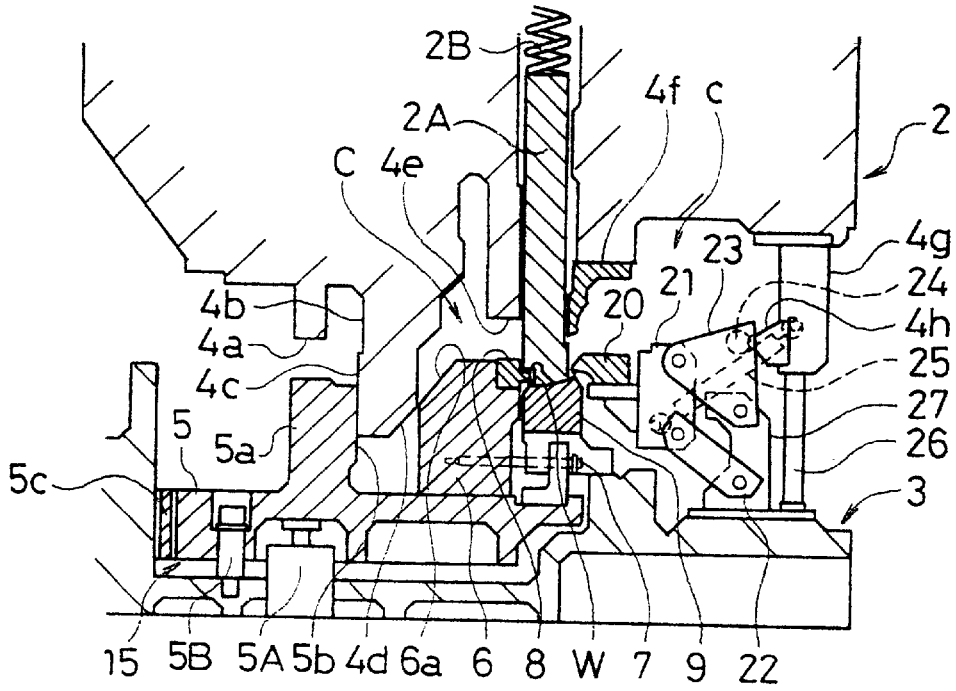
FIG. 3A and FIG. 3B each is a cross-sectional view showing the procedure of processing the hemming apparatus of the present invention.

As shown in FIG. 2, FIG. 3, and FIG. 5, height of each of driver cams 4*b* of the upper mold 2 is adjusted so that one which is position on the corner portion wc to be bent of the internal circumference Wa has a faster driving timing of the slide cam 6 to be pushed than one which is positioned on the linear portion ws to be bent of the internal circumference Wa. In addition, the height of each of the driver cams 4*g* for previously bending the external circumference which are placed on the corner portion wc to be bent of the external circumference Wb is adjusted so that the drive timing of the previous bending punch 20 for the external circumference becomes faster than that of one which is placed on the linear portion ws to be bent of the external circumference Wb.

Next, the functions of bending (hemming) the work W by the use of the hemming apparatus 1 according to the present invention will now be described.

Figure 3B:
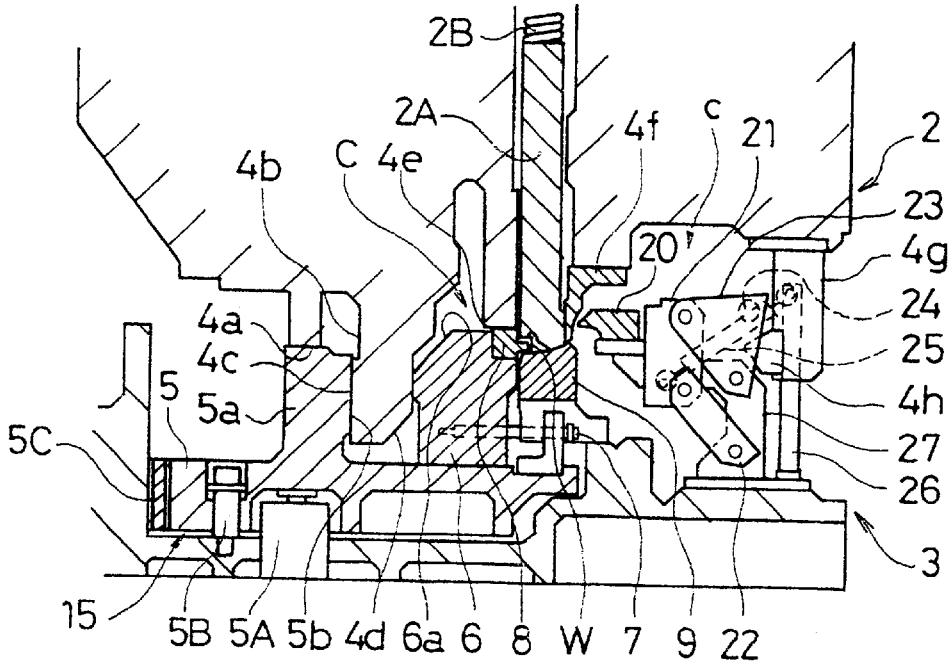
Figure 4A:
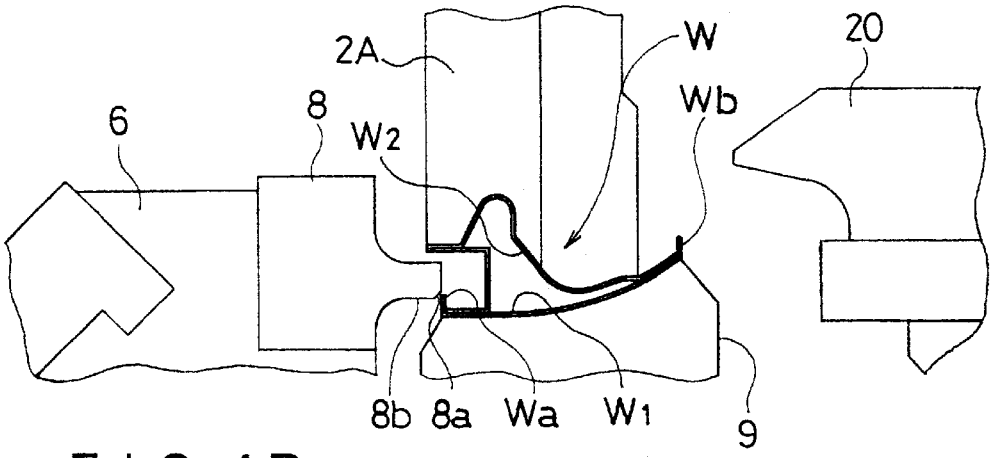
FIG. 4A, FIG. 4B, and FIG. 4C each is a cross-sectional view showing the procedure of molding the work by means of the hemming apparatus of the present invention.

As shown in FIG. 1, when a robot arm (not shown) is placed on the lower mold 3 at a prescribed position, the upper mold 2 descends as shown in FIG. 3 and FIG. 4A whereby the presser 2A fixes and supports the work W onto the hemming die 9.

Figure 6A:
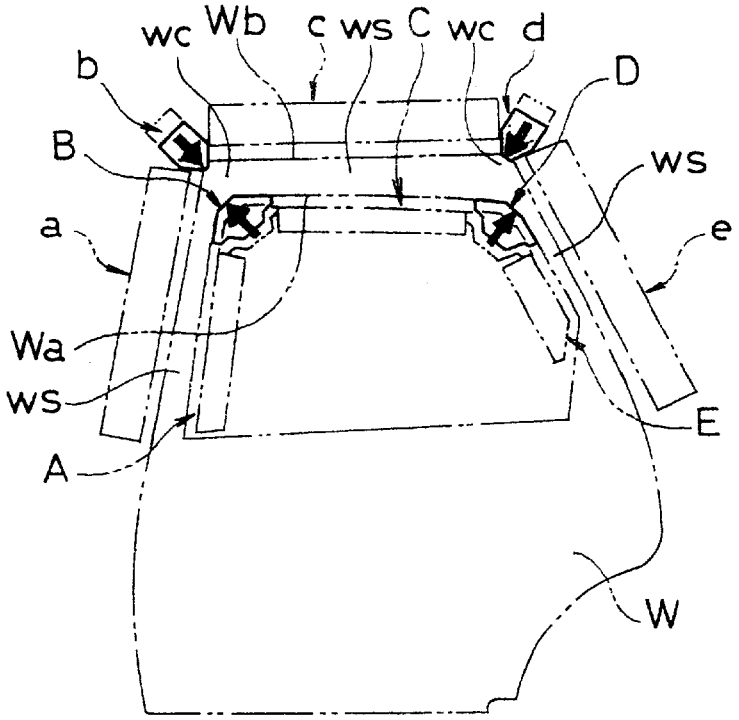
FIG. 6A and FIG. 6B each shows a plane view outlining the processing conditions of the hemming apparatus according to the present invention.

When the work W is fixed and supported, the upper mold 2 further descended. In this case, as shown in FIG. 6A, FIG.

3A, and FIG. 4A, at the side of internal circumference Wa of the work W, the slide cams 6 and 6 of the internal circumference corner hemming mechanisms B and D are pushed by respective driver cams 4*b* and 4*b* to previously bend the curved portion wc of the internal circumference Wa by means of the previous bent portions 8*a* and 8*a* fixed onto the slide cams 6 and 6 at the first time.

On the other hand, at the external circumference side, previous bending mechanism b and d for previous bending of the external circumference corners placed on the corner portion wc to be bent of the external circumference W move the previous bending punchs20 and 20 by pushing the contact interlocking portions 24A and 24A against the springs 25 and 25 by means of the contact pushing portions 4*h* and 4*h* of the driver cams 4*g* and 4*g* for previous bending of the external circumference to carry out previous bending of the corner portion wc to be bent of the external circumference Wb at this time.

Figure 4B:
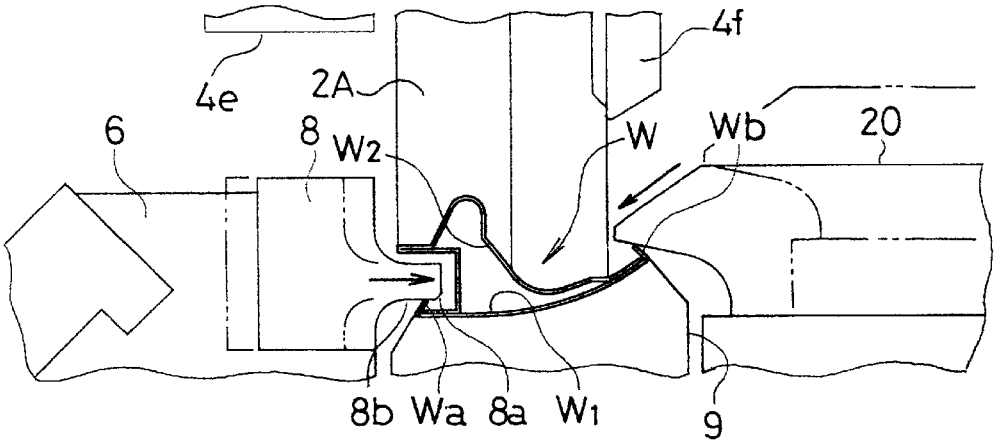

Subsequently, as shown in FIG. 4B and FIG. 6, by further descending the upper mold 2 (presser 2A in FIG. 4B) , the slide cams 6 and 6 of the internal circumference corner hemming mechanisms B and D (see FIG. 6) placed on the corner portion wc to be bent are pushed to further go forward so that the internal circumference Wa is positioned on the lower face of the bending portion 8*b* of the hemming punch 8. At this time, since the pushing of the driver cams 4*g* and 4*g* for previous bending of the external circumference (see FIG. 3A and FIG. 5) by the contact pushing portions 4*h* and 4*h* is completed, the previous bending punchs20 and 20 go backward by means of springs 25 and 25 (see FIG. 3A and FIG. 5).

Figure 6B:
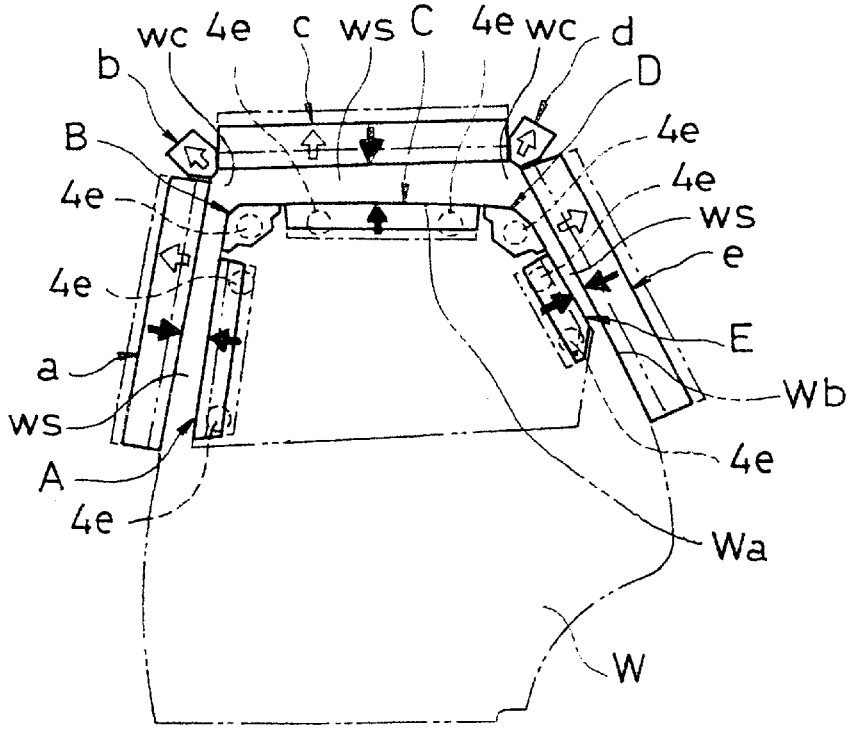
Figure 7:
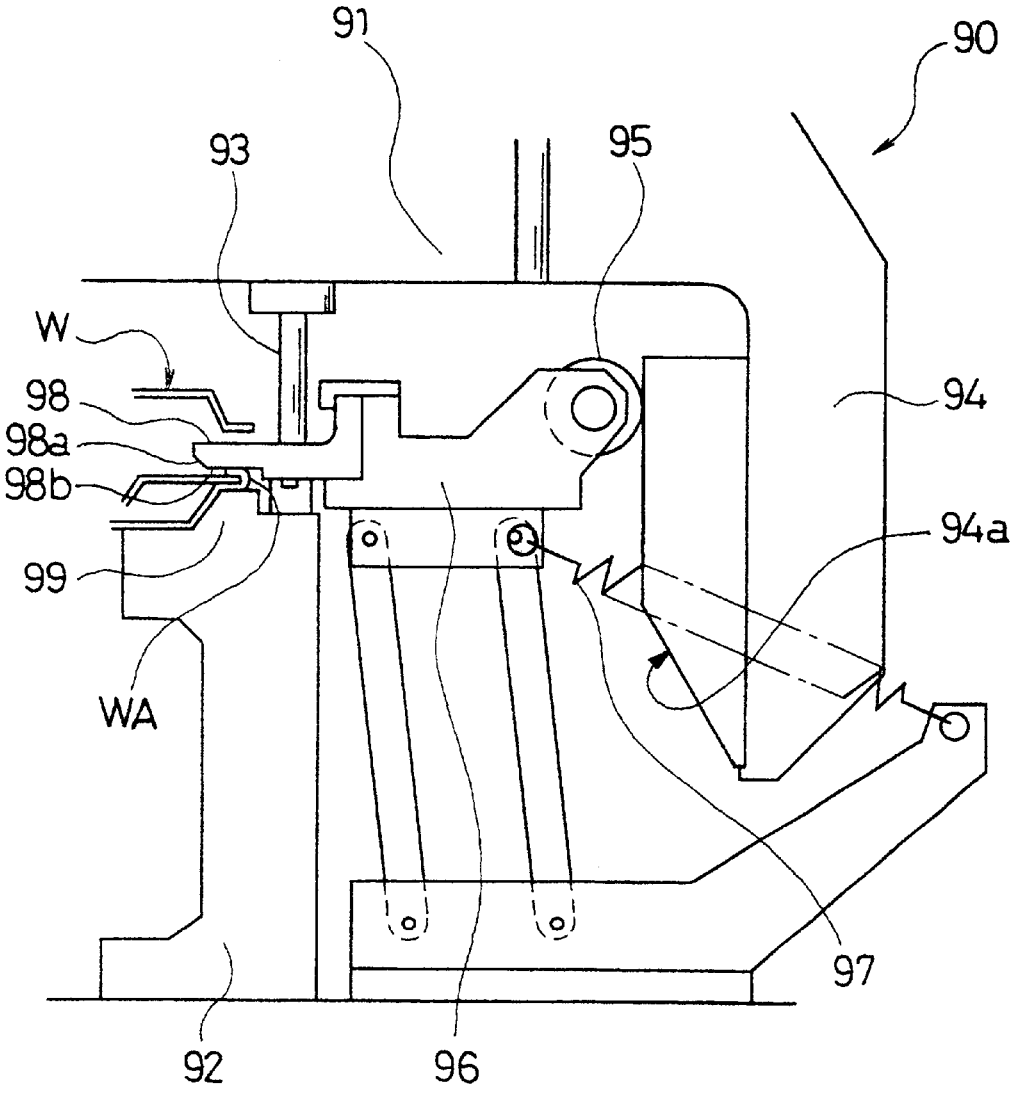
FIG.7 PRIOR ART
FIG. 7 is a side view showing a conventional hemming apparatus.
Figure 8:
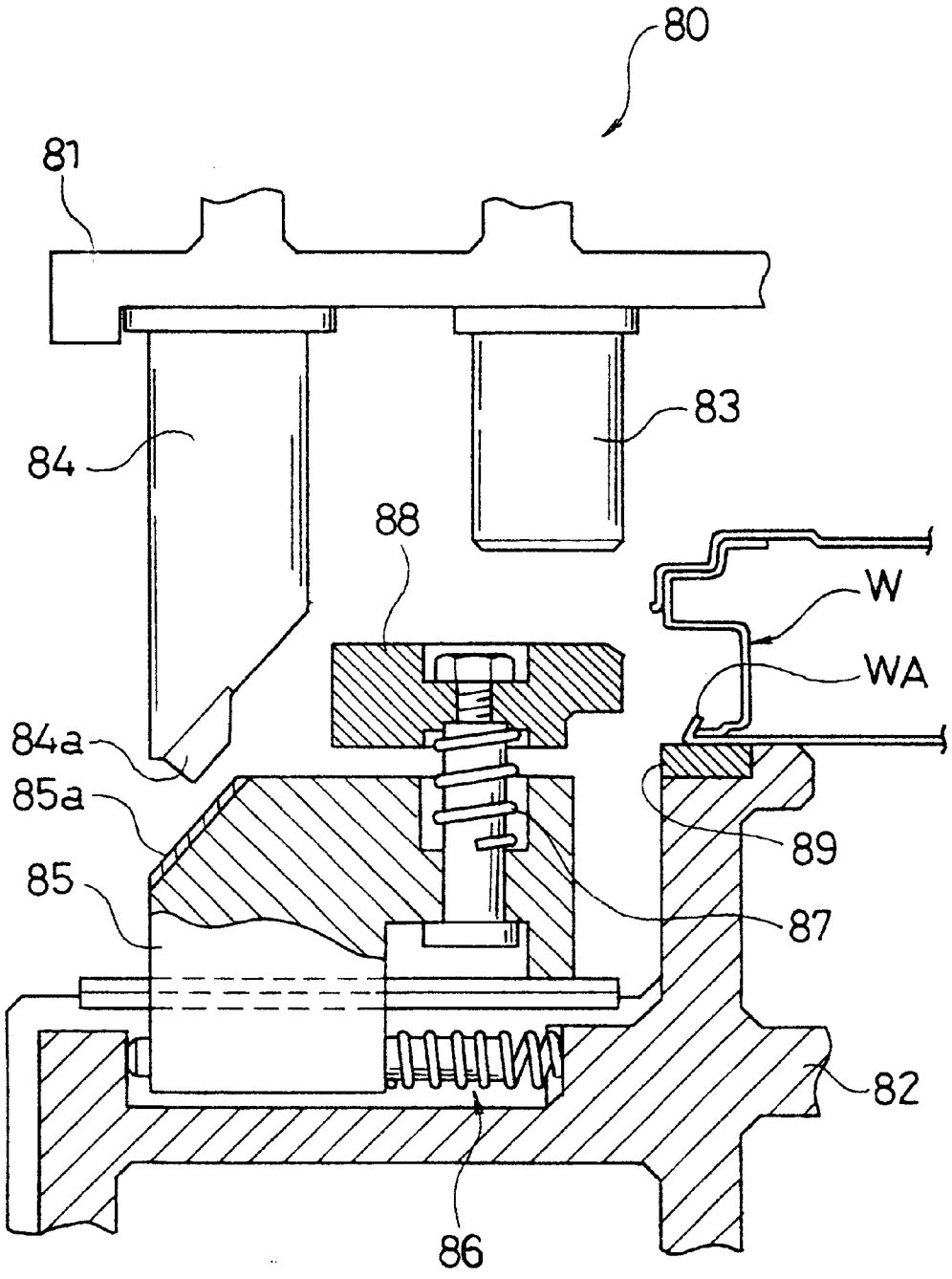
FIG. 8 PRIOR ART
FIG. 8 is a side view showing another conventional hemming apparatus.

As shown in FIG. 6B, the respective drive cams 6 of the internal circumference hemming mechanisms A, C, and E placed on the linear portions ws to be bent of the internal circumference Wa and external circumference Wb are pushed by the respective driver cams 4b. For this reason, the respective hemming punches 8 previously bend the linear portion ws to be bent of the internal circumference Wa (see FIG. 4B), and the hemming punches 8 move so that the previously bent portion of the internal circumference Wa is positioned at the lower face of the portion 8*b* to be bent of respective hemming punches 8 (see FIG. 4B).

At this time, as shown in FIG. 6B, the external circumference previous bending hemming mechanisms a, c, and e conduct the previous bending of the external circumference Wb by the previous bending punches 20 for carrying out previous bending by means of respective driver cams 4*g* for previous bending of the external circumference (see FIG. 4B), and since the pushing of the contact pushing portions 4*h* and 4*h* of the driver cams 4*g* and 4*g* for previous bending of the external circumference is finished by descending driver cams 4*g* for previous bending of the external circumference, the previous bending punches 20 and 20 for carrying out previous bending go backward by means of the springs 25 and 25 (see FIG. 4B).

Figure 4C:
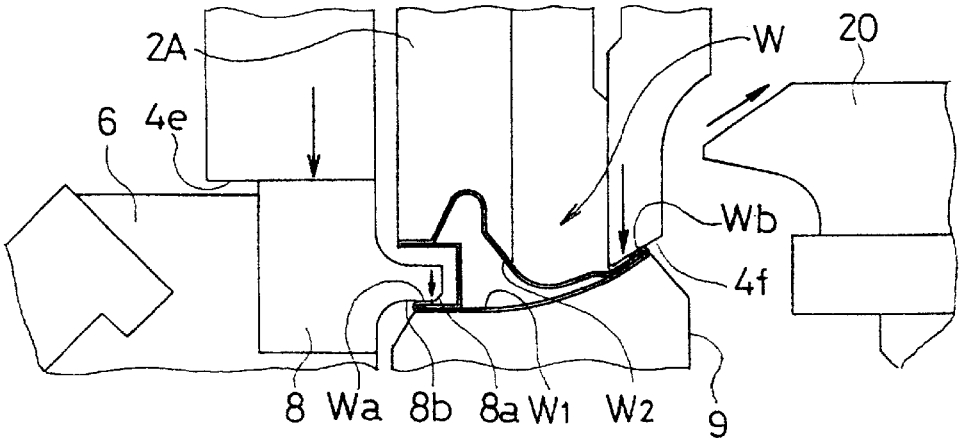

Subsequently, when the previous bending of the internal circumference Wa and the external circumference Wb is finished, as shown in FIG. 3B and FIG. 4C, the upper mold 2 is further descended to push hemming punches 8 residing at respective positions by means of the liners 4*e* residing at respective positions (see FIG. 6B). This conducts the bending of the internal circumference Wa and, at the same time, conducts the bending of the external circumference Wb by pushing the hemming punches 4 for external circumference residing at the respective positions.

As shown in FIG. 3B, in the case where the internal circumference Wa is bent, by pushing down the hemming punches 8 and the holder pushing stand 5*a* placed on the cushion holder 5 by liners 4*e* and 4*a,* the cushion holder 5 on which respective slide cams 6 are placed and supported is downwardly guided by the holder guide 5C against the resilient force of the gas spring 5A and, thus, is descended, whereby the hemming punches 8 residing at the respective positions can conduct the bending of the internal circumference Wa.

When the hemming of the work W has been finished, the upper mold 2 is ascended to set the pushing of the liners 4*a* and 4*e* free, whereby the upper mold 2 is ascended to a prescribed position and then stopped. In the case of ascending the upper mold 2, the driver cams 4*g* for previous bending of the external circumference push the contact interlocking portions 24 to drive the previous bending punches 20 for the external circumference, but they never come in contact with the external circumference Wb which has been bent.

While the description has been made to use the door panel as the work W, the shape of the work is not restricted to the door panel. For example, even if the work is bent at the position of internal circumference, the hemming process of the present invention can be carried out. Moreover, the radius of curvature of the corner portion wc is not specifically restricted. Also, the portion or portions to be bent may be one, three or more. Similarly, the linear portion ws to be bent includes moderate curved portion.

As described above, the present invention having the configuration mentioned previously has the following advantages:

a) The hemming apparatus of the present invention in which a slide cam is placed and supported on a cushion holder at the internal circumference side which is narrow space can conduct the bending of the curved portion and the linear portion of the work at the same time. What is more, the hemming apparatus of the present invention can also conduct the bending of the internal circumference and the external circumference of the work at one step. For such reasons, the hemming apparatus can be manufactured into a small size. Also, the hemming apparatus of the present invention can process the internal circumference and the external circumference of the work at the same timing. This makes it possible to suppress the deformation as little as possible.

b) In the slide cam of the hemming apparatus of the present invention possessing a cam follower, a previous bending portion, and a bending portion, the slide cam moves horizontally by means of a moving mechanism and moves vertically by a cushion holder, and thus, the compression loss can be minimized. Consequently, the precision of bending a work can be improved.

c) The hemming punch having the previous bending portion of the hemming apparatus of the present invention has no portion to be adjusted, making it easy to adjust the compression timing.

(e) In the hemming apparatus of the present invention, since the slide cam is placed on and supported by a cushion holder, the apparatus can be simplified as a whole, and the adjacent internal circumference hemming mechanisms can be easily adjusted, making it easy to design and construct the hemming apparatus.

What is claimed is:

1. A hemming apparatus (1) composed of opposing upper mold (2) and lower mold (3); said lower mold includes:

a hemming die (9) positioning and supporting a work piece;

a hemming punch (8) including a first bending portion and a second bending portion each placed adjacent to said hemming die and provided to bend said work, a slide cam (6) for fixing and supporting said hemming punch and including a cam follower (6*a*), a moving mechanism (7) for applying a resilient force to said slide cam in one direction and biasing said slide cam to a prescribed position, a cushion holder (5) positioning and supporting said slide cam and said moving mechanism, and a movable supporting mechanism supporting said cushion holder said moveable supporting mechanism being selectively vertically positionable to facilitate selective movement of said cushion holder to a prescribed position; and said upper mold includes:

a presser (2A) for pressing and fixing the work piece on said hemming die, a driver cam (4*b*) for pushing said cam follower of said slide cam; and a liner (4*e*) for pushing said hemming punch.

2. A hemming apparatus (1) composed of opposing upper mold (2) and lower mold (3) said lower mold includes:

a hemming die (9) positioning and supporting a work piece;

a hemming punch (8) including a first bending portion and a second bending portion each placed adjacent to said hemming die and provided to bend a first side portion of said work piece, a slide cam (6) for fixing and supporting said hemming punch and including a cam follower (6*a*), a moving mechanism (7) for applying a resilient force to said slide cam in one direction and biasing said slide cam to a prescribed position, a cushion holder positioning and supporting said slide cam and said moving mechanism, a movable supporting mechanism supporting said cushion holder said moveable supporting mechanism being vertically positionable to facilitate selective movement of said cushion holder to a prescribed position; and a first bending punch (a, c, e) for initially bending a second side portion of the work piece; and said upper mold includes:

a presser (2A) for pressing and fixing the work on said hemming die, a first driver cam (4*b*) for pushing said cam follower of said slide cam; and a liner (4*a*) for downwardly moving said cushion holder, a second driver cam for driving said first bending punch for initially bending the second side portion of the work piece; and a second bending punch for subsequently bending said second side portion of the work piece.

3. A hemming process for carrying out the hemming using the hemming apparatus (1) as set forth in claim 1, characterized by comprising:

a first step for supporting and fixing said work (W) onto said hemming die (9);

a second step for carrying out previous bending of the portion of the work to be bent at the internal circumference corner sides via the hemming punch (20) by means of the movement of said slide cam (6) an at the same time carrying out previous bending of the portion of the work to be bent at the external circumference corner sides via said hemming punch for previous bending;

a third step for carrying out previous bending of the portion of the work to be bent at the internal circumference linear sides via the hemming punch by means of the movement of said slide cam and at the same time carrying out previous bending of the portion of the work to be bent at the external circumference linear sides via said hemming punch for previous bending; and a fourth step for moving the cushion holder (5) downwardly via the movable supporting mechanism by forwarding the hemming punch residing at the previous bending the internal circumference position of the work by means of the movement of the slide cam and then by pushing the hemming punch by the liner (4*e*) placed on the upper mold to carry out the bending of the internal circumference (Wa) of the work, and carrying out the bending of the external circumference (Wb) of the work by the external circumference bending punch.

4. A hemming process for carrying out hemming using the apparatus as set forth in claim 2, the process comprising the steps of:

supporting and fixing said work piece onto said hemming die;

lowering said upper mold and initially bending said first side of said work piece adjacent a corner portion thereof by means of movement of said slide cam to force said hemming punch to engage said first side and simultaneously initially bending said second side of said work piece adjacent said corner portion thereof by engagement with aid first bending punch, and initially bending said first side of said work piece adjacent a linear portion thereof by moving said slide cam to force said hemming punch to engage said first side adjacent said liner portion and simultaneously bending said second side of said work piece adjacent said linear portion by engagement with aid first bending punch; and continuing to lower said mold and causing the cushion holder to move downwardly by engagement with said liner and causing the hemming punch to move downwardly by engagement with a second liner of said upper mold and subsequently bend said first side of said work piece, and causing said second bending punch to move downwardly and engage and subsequently bend said second side of said work piece.

5. A hemming apparatus comprising at least one upper mold and at least one lower mold;

said at least one lower mold includes:

a plurality of hemming dies positioning and supporting a work piece;

a plurality of hemming punches each including a first bending portion and a second bending portion each placed adjacent to an associated one of said hemming dies and provided to bend a first side of said work piece, a plurality of slide cams for fixing and supporting said hemming punch and each including a cam follower, a plurality of moving mechanisms for applying a resilient force to an associated one of said slide cams in one direction and biasing said slide cams to a prescribed position, a plurality of cushion holders one each positioning and supporting an associated one of said slide cams and said moving mechanism, at least one movable supporting mechanisms supporting said cushion holders, said at least one moveable supporting mechanisms being vertically positionable to facilitate selective movement of said cushion holders to a prescribed position; and a plurality of first bending punches for initially bending a second side portion of the work piece; and said upper mold includes:

a plurality of pressers each for pressing and fixing the work piece on an associated one of said hemming dies, a plurality of first driver cams one each for pushing an associated one of said cam followers of said slide cams; and a plurality of liners one each for downwardly moving an associated one of said cushion holder, a plurality of second driver cams one each for driving an associated one of said first bending punches for initially bending the second side portion of the work piece; and a plurality of second bending punches for subsequently bending said second side portion of the work piece.

6. The hemming mechanism according to claim 6, wherein said plurality of hemming punches include at least a first punch positioned and adapted to punch an linear portion of said work piece and at least a second punch positioned and adapted to punch a non-linear portion of said work piece.

7. The hemming apparatus according to claim 5, wherein said work piece comprises a plurality of linear and non-linear portions to defining an inner peripheral surface and an outer peripheral surface, wherein said first side portion being said inner peripheral surface and said second side portion being said outer peripheral surface.

* * * * *